United States Patent [19]

Gilgore

[11] Patent Number: 4,868,075

[45] Date of Patent: Sep. 19, 1989

[54] ELECTROPHOTOGRAPHIC IMAGING PROCESS

[75] Inventor: Wayne M. Gilgore, Patterson, N.Y.

[73] Assignee: Polychrome Corporation, Yonkers, N.Y.

[21] Appl. No.: 171,962

[22] Filed: Mar. 23, 1988

[51] Int. Cl.[4] ..... G03G 13/01; G03G 13/22

[52] U.S. Cl. ..... 430/45; 430/97; 430/102; 430/103; 430/104; 430/105

[58] Field of Search ..... 430/102, 103, 97, 105, 430/104, 45

[56] References Cited

U.S. PATENT DOCUMENTS

| | | | |
|---|---|---|---|
| 4,076,406 | 2/1978 | Talmage et al. | 430/103 |
| 4,500,195 | 2/1985 | Hosono | 355/3 R |
| 4,510,223 | 4/1985 | Kuehnle et al. | 430/45 |
| 4,713,307 | 12/1987 | Law et al. | 430/57 |

FOREIGN PATENT DOCUMENTS

| | | | |
|---|---|---|---|
| 1223984 | 3/1971 | United Kingdom | 430/103 |

*Primary Examiner*—Paul R. Michl
*Assistant Examiner*—Jeffery A. Lindeman
*Attorney, Agent, or Firm*—Ostrolenk, Faber, Gerb & Soffen

[57] ABSTRACT

An electrophotographic imaging process. The process utilizes a disposable photoconductor and develops the photoconductor in fresh toner. The toner is packaged in a pod to protect its freshness and dispense a predetermined quantity of toner. The toner contains a one-shot application, but the process may be repeated for various colors. In the process, a charge plate is exposed to form a latent image, or a pre-exposed plate is charged to form a latent image. The latent image is contacted with toner released from the pod onto a development electrode. A cleanup electrode is provided for excess toner and the image is subsequently transferred to a substrate to produce a print, or the image is fixed on the photoconductor to make a lithographic, di-litho or letterpress plate.

19 Claims, 2 Drawing Sheets

ELECTROPHOTOGRAPHIC IMAGING PROCESS

BACKGROUND OF THE INVENTION

1. Field of the Invention

The present invention relates to an electrophotographic imaging process. More specifically, the present invention relates to an electrophotographic imaging process which uses a disposable photoconductor and develops each photoconductor in a predetermined quantity of fresh toner provided from a toner pod.

2. Description of the Related Art

Various electrophotographic imaging processes have been developed for producing an image on a photosubstrate. In typical electrophotographic imaging processes the photoconductor is reused numerous times. Also, the toner is repeatedly used before being replenished. Accordingly, the electrophotographic processes of the prior art have an image quality problem. The quality of the image produced becomes increasingly poor during the lifetime of the photoconductor because of degeneration of the image producing capability of the photoconductor and toner.

The conventional process of the prior art is exemplified by Kingsley U.S. Pat. No. 4,088,403. This patent discloses a reproducing machine in which a photosensitive element is used for a predetermined interval and then removed with a fresh photosensitive element being supplied. The photosensitive element, however, is an endless photoconductor belt which is supplied from a roll. At a first station the photoconductor belt is charged to a uniform potential. The photoconductor belt is then advanced and exposed at an exposure station. An electrostatic latent image recorded on the photoconductor member is then advanced to a development station where a magnetic brush developer unit deposits toner particles on the electrostatic latent image. Finally, the image is transferred and fixed to a substrate. The images produced according to this patent, however, experience degeneration of image quality because of repeated use of the toner. Additionally, providing a roll of photoconductive material is expensive and bulky. The roll must be accommodated within the machine, and supply and take-up mechanisms must be provided.

Hosono U.S. Pat. No. 4,500,195 also discloses an image-forming machine which utilizes a photoconductor drum for a predetermined interval followed by replacement of the drum. The photoconductor drum is contained in a detachable unit including a toner supply cartridge and a toner recovery container. The detachable unit, however, is utilized to produce numerous quantities of images and, as with the Kingsley patent, degenerates in image producing capability.

The prior art has also attempted to solve problems arising in the toner supply mechanism. Specifically, Japanese Pat. No. 53,675 provides a toner bottle having a burstable bag located within the bottle. The toner is located within the bag. This patent, however, is concerned with containment of the toner. The toner is not supplied in a one-shot predetermined amount. Rather, the toner is merely released from the bag and is contained in the toner bottle as a toner reservoir presumably to be used repeatedly. Furthermore, this patent also does not prevent the image degeneration of the above prior art.

SUMMARY OF THE INVENTION

Accordingly, it is an object of the invention to provide an electrophotographic process which utilizes a pod of a pre-measured amount of toner.

Another object of the present invention is to provide an electrophotographic process with a disposable photoconductor.

A further object of the invention is to provide an electrophotographic process which prevents degeneration of image quality by utilization of a pod of toner containing a predetermined amount of toner to produce a one-shot application of toner.

These and other objects are achieved by the present invention, comprising a process of exposing a charge plate to form a latent image followed by releasing a pre-measured amount of toner from a pod positioned over a development electrode by either bursting the pod or peeling it open. The charge plate is then passed through the toner to develop a toned image on the charge plate. A cleanup electrode accumulates any loose toner. The toned image is then transferred to a substrate from the photoconductor and the photoconductor is disposed.

DETAILED DESCRIPTION OF THE PREFERRED EMBODIMENTS

Figure 1:
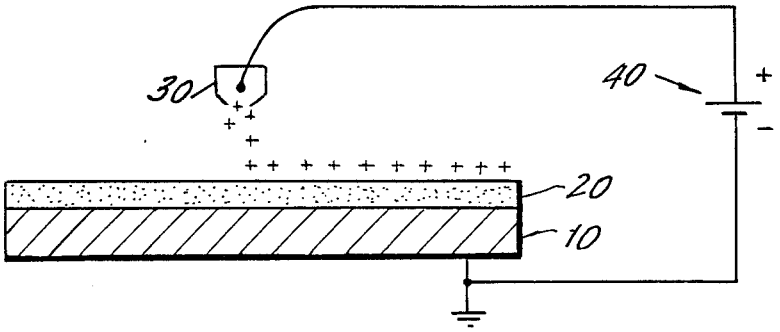
FIG. 1 shows the first step of the present invention comprising sensitizing the photoconductive substrate.

The first step of the present invention consists of sensitizing a photoconductive layer. Referring to FIG. 1, photoconductive layer 20 is located on a conductive substrate 10. Photoconductive layer 20 may be deposited upon conductive substrate 10 by any suitable method, e.g., vacuum evaporation. Photoconductive layer 20 is a thin layer, usually between 20 to 100 microns and may be amorphous selenium, but any suitable photoconductor material may be utilized. Furthermore, any suitable conductive substrate may be employed in the present invention.

Sensitizing of the photoconductor can be achieved by numerous methods, for example, by a radioactive source, an electrostatic induction source, or conductive rubber roller. However, the use of a corona discharge apparatus is illustrated in FIG. 1. A corona emitter 30 is powered by power supply 40 to produce an electrical discharge. The discharge illustrated in FIG. 1 is positive, but a negative discharge may be employed.

Figure 2:
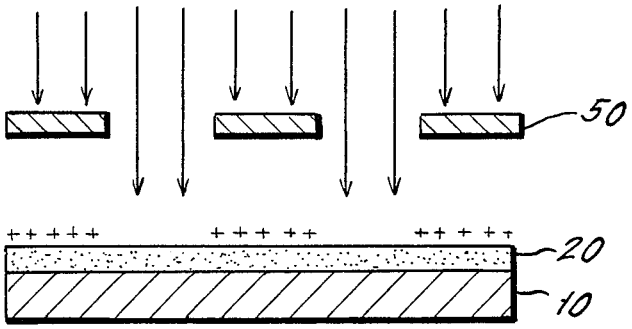
FIG. 2 shows formation of an image in the sensitized photoconductor by irradiation with light.

Once the photoconductive layer 20 is sensitized, a latent image is formed in the photoconductive layer by selective irradiation. Referring to FIG. 2, photoconductive layer 20 is irradiated with light, illustrated by the arrows, through mask 50. In the regions of photoconductive layer 20 which are incident to the light, electrical charges are conducted away from photoconductor layer 20. A latent image remains in the photoconductive layer 20 not incident to the light.

Figure 3:
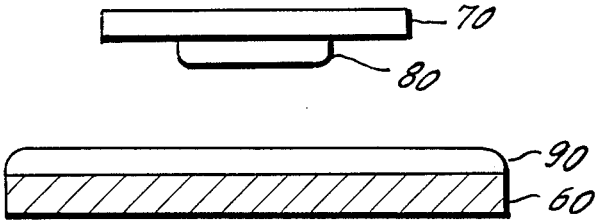
FIG. 3 shows the toner pod positioned over the development electrode and ready to release toner onto the development electrode.

In FIG. 3, the action of the toner pod in the present invention is illustrated. Toner pod 80, having toner 90 therein prior to bursting, is fixedly maintained on support plate 70 positioned over developement electrode 60. Toner pod 80 contains a pre-measured amount of toner for a one-shot application. In other words, toner pod 80 contains the amount of toner necessary to provide one application of the toner pod contents. After bursting toner pod 80, toner 90 in a pre-measured amount for a one-shot application, forms a layer on development electrode 60 as shown in FIG. 3. Additionally, the toner pod 80 is pre-formulated for proper strength and density.

In operation, the toner pod 80 is constructed of a burstable or a peel-open material. The material contains a mechanism such as a tear strip or score lines strategically located on the toner pod exterior to enable opening of the toner pod 80 and release of toner onto development electrode 60. Because toner pod 80 provides only the amount of toner necessary for development, toner is not reused and the image quality is not diminished with time.

Development electrode 60 reduces fringe electric fields which develop at the edge of the latent image produced in the photoconductor layer 20. The development electrode 60 may be made from any suitable metallic material and is typically a metal sheet.

Figure 4:
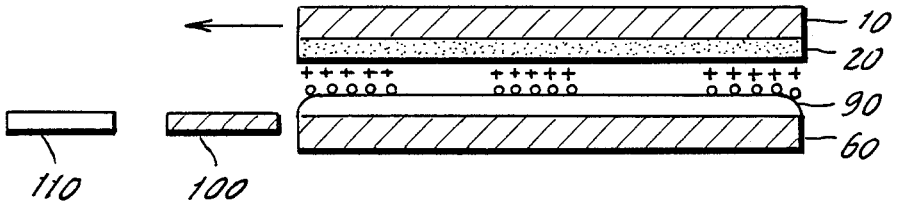
FIG. 4 shows development of the latent image in the photoconductor.

Referring to FIG. 4, after toner pod 80 has been opened and toner 90 deposited on development electrode 60, the latent image contained in photoconductor layer 20 is developed by passing the photoconductor layer 20 through the pre-measured toner released from toner pod 80. Negatively charged toner particles are retained on the positively charged latent image. A cleanup electrode 100 may be located at the egress of the photoconductor layer 20 from the region above the development electrode 60. Cleanup electrode 100 retains any loose toner not adhered to the photoconductor layer. Additionally, a wipe 110 may be provided at the egress of the photoconductor layer 20 from the region above the cleanup electrode 100 to wipe any additional loose toner particles. Photoconductor layer 20 is cleaned toner in excess of that needed to produce the toned image by cleanup electrode 100 and wipe 110, as discussed above. The development electrode 60, the photoconductor 20 and toner pod 80 are disposable and are contained in a moldable cover. Furthermore, the cleanup electrode 100, and wipe 110 may be contained in the moldable cover. In this case, the development electrode 100 and wipe 110, in addition to the photoconductor 20, the development electrode 60 and toner pod 80, are also disposable. A toned image is then produced on the photoconductor layer 20 comprising a positively charged latent image with negatively charged toner particles attracted to the latent image.

Figure 5:
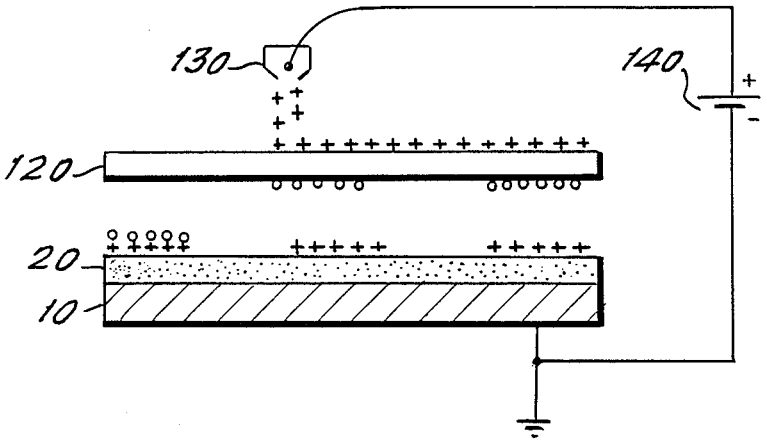
FIG. 5 shows transfer of the developed image to photosubstrate.

The remaining step of the present invention consists of transferring the toned image from the photoconductor layer 20 to a substrate. The substrate after which the photoconductor may be disposed may comprise paper but may be any suitable material as will be discussed below. Referring to FIG. 5, a substrate is sensitized on its first major surface, with a second major surface in close proximity to the toned image located on the photoconductor layer 20. Negatively charged toner particles adhered to the positively charged latent image are attracted to sensitized substrate 120.

Alternatively, the toned image may be transferred to substrate 120 by adhesive paper. The adhesive paper process is not illustrated, but may be summarized as follows. Adhesive paper is applied to photoconductor layer 20. A roller is then rolled over the adhesive paper to ensure a good contact, and the paper is peeled off. Subsequently, the negatively charged toner particles adhered to the photosubstrate and are transferred. The transferred image is then fixed to the photosubstrate. Any suitable fixing method may be employed.

The novel process of the present invention allows for application of a pre-measured and pre-mixed amount of toner to the development electrode. Additionally, the photoconductor is disposed after use. Thus, the image produced has excellent image quality.

While the present invention has been discussed in the general field of electrophotographic image development, it finds specific application in numerous processes. For example, the present invention is particularly applicable to electrostatic color proofing. Electrostatic color proofing utilizes application of various colors as part of a multilayer, multicolor printing scheme. Accordingly, the pre-measured toner pod of the present invention is ideal in the one-shot application of the various colors. Because the toner is typically liquid in electrostatic color proofing, a vacuum cleanup mechanism may be utilized in addition to the cleanup electrode and wipe discussed above.

Although the present invention has been described in connection with a plurality of preferred materials and processes thereof, many other variations and modifications will become apparent to those skilled in the art. For example, the novel process of the present invention may be utilized in connection with the production of displays, signs, posters, billboards, mastermaking, and platemaking. Other applications would be short run printing and offset printing plates being either additive or subtractive. Additionally, protective coatings such as gum, overprint fixations and lacquer may be applied to the various equipment by appropriate chemical and disposable development systems.

It is preferred, therefore, that the present invention be limited not by the specific disclosure herein, but only by the appended claims.

What is claimed is:

1. An electrophotographic imaging process which reduces the degeneration of image quality by one time use of a non-reusable photoconductor, and development electrode, comprising the steps of:

sensitizing said photoconductor with charged particles having a first electrical charge;

exposing said photoconductor to light to form a latent image in said photoconductor, said latent image comprising charged areas of said first electrical charge;

releasing a premeasured amount of electrostatic toner from said toner pod onto said development electrode, said electrostatic toner having a second electrical charge opposite to said first electrical charge, said premeasured amount being an amount sufficient for one application of said toner particles;

developing said latent image by bringing said photoconductor into close proximity to said premeasured amount of said electrostatic toner released from said toner pod to attract and adhere a portion of said electrostatic toner to said charged areas which form said latent image;

transferring said portion of said electrostatic toner from said charged areas which form said latent image to a substrate to produce an electrophotographic image on said substrate followed by fixing said electrophotographic image to said substrate; and, disposing said photoconductor and development electrode.

2. An electrophotographic imaging process as claimed in claim 1, wherein the step of exposing said photoconductor is effected by exposure through a mask or exposure by scanning.

3. An electrophotographic imaging process as claimed in claim 1, wherein said electrostatic toner is selected from the group consisting of liquid and dispersent, dry toner particles and carrier, and single component toner.

4. An electrophotographic imaging process as claimed in claim 1, wherein said electrophotographic imaging process is completed for one color and repeated for additional colors.

5. An electrophotographic imaging process as claimed in claim 1, wherein said toner pod is located above said development electrode.

6. An electrophotographic imaging process as claimed in claim 1, further comprising the step of passing said photoconductor with said electrostatic toner adhered thereto over a cleanup electrode positioned to accumulate any loose amount of said electrostatic toner not adhered to said charged areas having a first electrical charge.

7. An electrophotographic imaging process as claimed in claim 6, further comprising the step of passing said photoconductor with said electrostatic toner adhered thereto over a wipe positioned after said cleanup electrode to further accumulate any loose amount of said electrostatic toner not adhered to said charged areas having a first electrical charge.

8. An electrophotographic imaging process as claimed in claim 1, wherein said toner pod comprises a burstable container.

9. An electrophotographic imaging process as claimed in claim 1, wherein said toner pod can be peeled open.

10. An electrophotographic imaging process as claimed in claim 1, wherein said development electrode is contained in a moldable cover.

11. An electrophotographic imaging process for colorproofing which reduces the degeneration of image quality by one time use of a non-reusable photoconductive substrate, development electrode and toner, comprising in sequence:

(a) sensitizing a disposable photoconductive substrate with charged particles having a first electrical charge;

(b) exposing said photoconductive substrate to light to form a latent image in said photoconductive substrate comprising charged areas having a first electrical charge;

(c) releasing a premeasured amount of colored toner particles from a toner pod onto a development electrode, said toner particles having a second electrical charge opposite to said first electrical charge and said pre-measured amount being an amount sufficient for one application of said toner particles;

(d) developing said latent image by bringing said photoconductive substrate into close proximity to said premeasured amount of said toner particles released from said toner pod to attract and adhere a portion of said toner particles to said charged areas which form said latent image;

(e) transferring said portion of said toner particles from said charged areas which form said latent image to a photosubstrate to produce an electrophotographic image on said photosubstrate followed by fixing said electrophotographic image to said photosubstrate;

(f) disposing said photoconductive substrate, said development electrode, and any leftover colored toner and repeating steps a–e for additional colors.

12. An electrophotographic imaging process as claimed in claim 11, wherein said exposing said photoconductor to light is completed by exposure through a mask or exposure by scanning.

13. An electrophotographic imaging process as claimed in claim 11, wherein said toner pod is located above said development electrode.

14. An electrophotographic imaging process as claimed in claim 11, further comprising the step of passing said photoconductor with said colored toner adhered thereto over a cleanup electrode positioned to accumulate any loose amount of said colored toner particles not adhered to said charged areas having a first electrical charge.

15. An electrophotographic imaging process as claimed in claim 14, further comprising the step of passing said photoconductor with said colored toner adhered thereto over a wipe or blotter positioned after said cleanup electrode to further accumulate any loose amount of said colored toner particles not adhered to said charged areas having a first electrical charge.

16. An electrophotographic imaging process as claimed in claim 11, wherein said toner pod comprises a burstable container.

17. An electrophotographic imaging process as claimed in claim 11, wherein said toner pod can be peeled open.

18. An electrophotographic imaging process as claimed in claim 1, wherein and said disposable photoconductive substrate, said development electrode, and said wipe or said blotter are contained in a moldable cover and are disposed together in said disposing step.

19. An electrophotographic imaging process as claimed in claim 11, further comprising after step (e) transferring and fixing said latent image on another substrate.

* * * * *